US007977025B2

(12) United States Patent
Nosella et al.

(10) Patent No.: US 7,977,025 B2
(45) Date of Patent: Jul. 12, 2011

(54) EMULSION AGGREGATION METHODS

(75) Inventors: Kimberly D. Nosella, Mississauga (CA); Tie Hwee Ng, Mississauga (CA); Allan K. Chen, Oakville (CA); Abdisamed Sheik-Qasim, Etobicoke (CA); David Kurceba, Hamiton (CA); Shigang Qiu, Toronto (CA); Santiago Faucher, Oakville (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/629,996

(22) Filed: Dec. 3, 2009

(65) Prior Publication Data

US 2011/0136058 A1 Jun. 9, 2011

(51) Int. Cl.
*G03G 9/08* (2006.01)

(52) U.S. Cl. ..... 430/137.14

(58) Field of Classification Search ..... 430/137.14
See application file for complete search history.

(56) References Cited

U.S. PATENT DOCUMENTS 5,278,020 A 1/1994 Grushkin et al.
5,290,654 A 3/1994 Sacripante et al.
5,308,734 A 5/1994 Sacripante et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
5,723,253 A 3/1998 Higashino et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,863,698 A 1/1999 Patel et al.
5,869,215 A 2/1999 Ong et al.
5,902,710 A 5/1999 Ong et al.
5,910,387 A 6/1999 Mychajlowskij et al.
5,916,725 A 6/1999 Patel et al.
5,919,595 A 7/1999 Mychajlowskij et al.
5,925,488 A 7/1999 Patel et al.
5,977,210 A 11/1999 Patel et al.
6,063,827 A 5/2000 Sacripante et al.
6,576,389 B2 6/2003 Vanbesien et al.
6,593,049 B1 7/2003 Veregin et al.
6,617,092 B1 9/2003 Patel et al.
6,627,373 B1 9/2003 Patel et al.
6,638,677 B2 10/2003 Patel et al.
6,656,657 B2 12/2003 Patel et al.
6,656,658 B2 12/2003 Patel et al.
6,664,017 B1 12/2003 Patel et al.
6,673,505 B2 1/2004 Jiang et al.
6,756,176 B2 6/2004 Stegamat et al.
6,830,860 B2 12/2004 Sacripante et al.
2006/0222991 A1 10/2006 Sacripante et al.
2007/0196754 A1* 8/2007 Matsumoto et al. ..... 430/137.14
2008/0199797 A1 8/2008 Sacripante et al.
2008/0233508 A1* 9/2008 Kamiyoshi et al. ..... 430/137.14
2008/0236446 A1 10/2008 Zhou et al.

OTHER PUBLICATIONS

U.S. Appl. No. 12/604,040, filed Oct. 22, 2009 in the name of Kimberly D. Nosella et al.
U.S. Appl. No. 12/056,337, filed Mar. 27, 2008 in the name of Kimberly D. Nosella et al.

* cited by examiner

*Primary Examiner* — Christopher RoDee
(74) *Attorney, Agent, or Firm* — Oliff & Berridge, PLC

(57) ABSTRACT

A method of making toner particles, including: mixing, at less than about 17° C. and without homogenizing, a resin emulsion with a coagulant, a colorant, an optional wax, and optional additives, to form pre-aggregated particles in a slurry; heating the slurry to form aggregated toner particles; freezing aggregation of the particles in the slurry once at a desired aggregated particle size; and further heating the aggregated particles in the slurry to coalesce the aggregated particles into toner particles.

19 Claims, No Drawings

EMULSION AGGREGATION METHODS

TECHNICAL FIELD

This disclosure is generally directed to methods for preparing a chemical toner, such as an emulsion aggregation toner. More specifically, this disclosure is directed to methods for making a toner particle by cold addition of a coagulant, which entails adding the coagulant directly to a cold slurry during emulsion aggregation processes without homogenization.

RELATED APPLICATION

Disclosed in commonly assigned U.S. patent application Ser. No. 12/604,040, filed Oct. 22, 2009 is a process for preparing a chemical toner with cold homogenization. The process comprises: cold homogenizing a resin emulsion, a colorant, an optional wax, and optional additives with a coagulant to form a homogenized toner slurry comprising pre-aggregated particles at a temperature of less than about 17° C.; heating the slurry to form aggregated toner particles; freezing aggregation of the particles in the slurry once at a desired aggregated particle size; and further heating the aggregated particles in the slurry to coalesce the aggregated particles into toner particles.

BACKGROUND

In a typical chemical toner process, such as an emulsion aggregation toner process, the process includes a step of homogenizing or high-shear mixing, an initial slurry to form "pre-aggregated particles" prior to aggregation and coalescence. Homogenization is carried out to evenly disperse a coagulant into the toner slurry and to break up the pre-aggregated particles that form upon addition of the coagulant to a desired average particle size. However, homogenization can be time consuming and energy intensive.

In a typical emulsion aggregation process, the final average toner particle size is about 5.8 μm and the pre-aggregated particle size is about 3.3 μm at room temperatures (about 17-25° C.). As such, to make a toner with a final average particle size of 3 or 4 μm is very difficult or impossible under the current processes because of the relatively large particle size of the pre-aggregated particles. For example, it would be very difficult to make such a toner when beginning with a 3 μm pre-aggregated particle to incorporate all the necessary components and still achieve a narrow geometric size distribution (GSD) while performing the conventional steps to make a toner. However, better image quality and lower toner coverage could be made possible by making toner particles with an even smaller average final particle size.

What's more, the typical emulsion aggregation steps are generally carried out in batch process mode due to the difficulty and expense of developing equipment capable of carrying out a homogenization step in a continuous process mode. As such, continuous processes, as opposed to batch processes, cannot be easily employed for typical emulsion aggregation processes and the economical and process benefits associated with continuous processes, such as increased throughput and automation, cannot be easily realized with current processes.

As a result, there exists a need to develop a continuous toner process with smaller sized pre-aggregated particles that may subsequently be coalesced to achieve much smaller final toner particles.

Also, in a typical emulsion aggregation process, a resin emulsion is made by mixing a resin with a solvent and/or a surfactant. Solvent-free emulsions are desirable because such emulsions result in no waste solvents and as such, can be more environmentally friendly. In addition, in view of increasing costs and regulation associated with waste disposal, it is desirable to avoid toner components associated with materials that cannot be conveniently, cost-effectively, and/or environmentally disposed. However, solvent-free emulsions require an increased surfactant loading, which can inhibit thickening of the slurry and, thus, reduce or inhibit effective homogenization of the slurry particles. This in turn results in high levels of % coarse particles and unacceptable GSDs.

As a result, there exists a need to develop a toner process that can accommodate for high surfactant loaded resin emulsions while still maintaining desirable and usable end products.

SUMMARY

The present disclosure in embodiments addresses these and other various needs and problems by providing a method of making toner particles, comprising:

mixing, at less than about 17° C. and without homogenization, a resin emulsion with a coagulant, a colorant, an optional wax, and optional additives, to form pre-aggregated particles in a slurry;

heating the slurry to form aggregated toner particles;

freezing aggregation of the particles in the toner slurry once at a desired aggregated particle size; and further heating the aggregated particles in the slurry to coalesce the aggregated particles into toner particles.

The method is carried out at a temperature where the coagulant is inactivated and does not include a homogenization or high-shear mixing step. The method can also be carried out in either batch or continuous modes.

These and other improvements are accomplished by the methods described in embodiments herein.

EMBODIMENTS

The current disclosure provides a process for making toner particles that includes mixing, at less than about 17° C. and without homogenizing, a resin emulsion with a coagulant, a colorant, an optional wax, and optional additives, to form pre-aggregated particles in a slurry; heating the slurry to form aggregated toner particles; freezing aggregation of the particles in the toner slurry once at a desired aggregated particle size; and further heating the aggregated particles in the slurry to coalesce the aggregated particles into toner particles.

In typical chemical emulsion aggregation processes, a homogenizer or other high-shear mixing device is used to evenly disperse the coagulant into the toner slurry and to break up coarse particles that form upon addition of the coagulant. In embodiments, "homogenizer," "homogenized," "homogenizing," and "homogenization" encompass any device, process, or procedure used to mechanically and evenly disperse the coagulant into the toner slurry. If the coagulant is added to the toner slurry without a homogenizer at room temperature, then coarse particles with a wide GSD are instantly formed. However, it has been found that if the coagulant is added to a cold slurry ("cold addition"), then the homogenization step can be completely removed while still achieving nanometer-sized pre-aggregated particles, narrow GSDs, and few, if any coarse particles. Cold temperatures allow for a better distribution of the coagulant because at such lower temperatures, the coagulation activity of the coagulant in combination with the raw materials is completely or effectively inhibited, thus allowing for dispersement of the coagulant into a toner slurry without coarse particle formation. Once the reactor is heated, then the well-dispersed coagulant in the toner slurry is activated to aggregate the toner components together.

Cold temperatures also allow for the use of resin emulsions with an increased surfactant loading by eliminating the need for homogenization. Currently, some emulsions are prepared by solvent-phase inversion emulsification. See, e.g., U.S. Patent Application Publication No. 2008/0236446, the entire disclosure of which is herein incorporated by reference. Such processes generally use solvents that cannot be easily recycled or reused. Other emulsions are prepared by solvent-free extruder emulsification. However, many resins, in particular crystalline and high molecular weight resins, require high surfactant loads to obtain acceptable, stable emulsions. With increased surfactant loading, typical emulsion aggregation toner processes, which include homogenization, cannot be used because the slurry does not thicken sufficiently for the shearing action of the homogenizer to be effective, resulting in high coarse content in the toner particles.

In embodiments, the process of the present disclosure results in numerous advantages, for example: (1) the expense of installing, maintaining, and running a homogenizer is eliminated; (2) the emulsion aggregation toner process can be carried out in one reactor; (3) the emulsion aggregation toner process can be continuously carried out without the increased expense and difficulty associated with a continuous process employing a homogenizer; (4) air ingestion in the reactor vessel as a result of homogenization is reduced or eliminated, thus enabling increased reactor loading by, for example, about 20% or more; (5) cycle time is reduced, such as by about 2 hours or more, by reducing coagulant addition time, eliminating homogenization time, and eliminating the need to transfer the slurry to another reactor after homogenization; (6) an increased range of surfactant loads in the toner formulations is enabled; (7) foaming during homogenization due to the higher surfactant loading is eliminated; (8) a broader range of resin emulsions is available for emulsion aggregation toner formation; (9) reduced use of environmentally damaging and/or dangerous solvents; (10) production of nanometer-sized pre-aggregated particles; (11) production of smaller final toner particles; and (12) increased process control resulting in desirable GSDs and coarse content.

In this specification and the claims that follow, singular forms such as "a," "an," and "the" include plural forms unless the content clearly dictates otherwise. All ranges disclosed herein include, unless specifically indicated, all endpoints and intermediate values. In addition, the terms "optional" or "optionally" refer, for example, to instances in which subsequently described circumstance may or may not occur, and include instances in which the circumstance occurs and instances in which the circumstance does not occur. Also, the terms "one or more" and "at least one" refer, for example, to instances in which one of the subsequently described circumstances occurs, and to instances in which more than one of the subsequently described circumstances occurs.

Resins and Polymers

In embodiments, the process may be used to make various toners, for example, polymer toners such as polyester toners and UV curable toners.

Polyester resins are known in the art. The specific polyester resin or resins selected for the present disclosure include, for example, unsaturated polyester and/or its derivatives, polyimide resins, branched polyimide resins, sulfonated polyesters, and any of the various polyesters, such as crystalline polyesters, amorphous polyesters, or a mixture thereof. Thus, for example, the toner particles can be comprised of crystalline polyester resins, amorphous polyester resins, or a mixture of two or more polyester resins where one or more polyester is crystalline and one or more polyester is amorphous. Illustrative examples of such resins may be found, for example, in U.S. Pat. Nos. 6,593,049, 6,756,176, and 6,830,860, the entire disclosures thereof being incorporated herein by reference.

The resin may be a polyester resin formed by reacting a diol with a diacid in the presence of a catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent, and the alkali sulfa-aliphatic diol can be selected in an amount of from about 0 to about 10 mole percent, in embodiments from about 1 to about 4 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), polyethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), pol(decylene-decanoate), poly-(ethylene-decanoate), poly-(ethylene-dodecanoate), poyl(nonylene-sebacate), poly (nonylene-decanoate), copoly(ethylene-fumarate)-copyly(ethylene-sebacate), copoly(ethylene-fumarate)-copyly(ethylene-decanoate), and copoly (ethylene-fumarate)-copyly(ethylene-dodecanoate), and combinations thereof.

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates such as titanium (iv) butoxide or titanium (iv) iso-propoxide, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.001 mole percent to about 0.55 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, crosslinked, for example, from about 10 percent to about 70 percent, branched alkali sulfonated-polyester resins, alkali sulfonated-polyimide resins, branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated polyester resin may be utilized as a latex resin. Examples of such resins include those disclosed in U.S. Pat. No. 6,063,827, the disclosure of which is hereby incorporated by reference in its entirety. Exemplary unsaturated polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable amorphous polyester resin may be a poly(propoxylated bisphenol A co-fumarate) resin having the following formula (I):

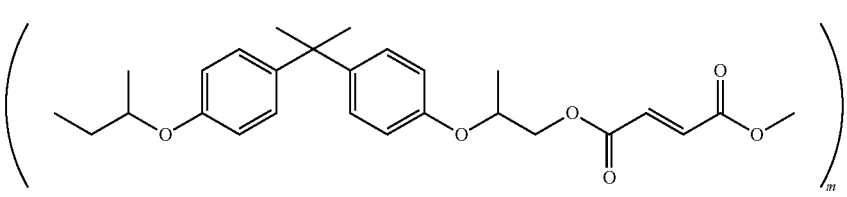

(I)

wherein in may be from about 5 to about 1000.

An example of a linear propoxylated bisphenol A fumarate resin which may be utilized as a latex resin is available under the trade name SPARII from Resana SIA Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

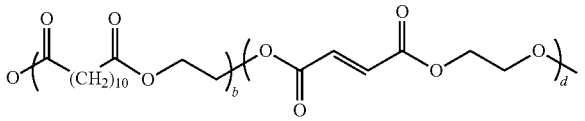

wherein b is from about 5 to about 2000 and d is from about 5 to about 2000.

One, two, or more toner resins/polymers may be used. In embodiments where two or more toner resins are used, the toner resins may be in any suitable ratio (e.g., weight ratio) such as for instance about 10% first resin:90% second resin to about 90% first resin:10% second resin. In embodiments, the amorphous resin utilized in the core may be linear.

UV curable resins are also known in the art. In embodiments, UV curable resins may be unsaturated polymers that can be crosslinked in the presence of activating radiation such as ultraviolet light and a suitable photo initiator. Illustrative examples of such resins and initiators may be found, for example, in U.S. Patent Application Publication No. 2008-0199797, the entire disclosure thereof being incorporated herein by reference.

In embodiments, the resin may be formed by emulsion polymerization methods. In other embodiments, a pre-made resin may be utilized to form the toner.

In embodiments, the resin may be added as an emulsion, such as a solvent-phase inversion emulsion or a solvent-free emulsion prepared by solvent-free resin emulsification.

Surfactants

In embodiments, an optional surfactant may be used. The surfactant may be added to the resin to form an emulsion and/or may be added to the slurry to help facilitate dispersion of the various components.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 10% by weight of the toner composition, for example from about 0.75% to about 7% by weight of the toner composition, in embodiments from about 1% to about 5% by weight of the toner composition. Thus, the surfactant can be absent or can be present in amounts of from about zero to about 15 pph, based on dry resins in the toner, for example from about zero to about 4 pph, from about 4 to about 9 pph, or from about 4 to about 6 pph.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants that may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUATT™, available from Alkaril Chemical Company, SANIZOL™ (benzalkonium chloride), available from Kao Chemicals, and the like, and mixtures thereof.

Waxes

In embodiments, the resin emulsion may be prepared to include an optional wax therein. In these embodiments, the emulsion will include resin and wax particles at the desired loading levels, which allows for a single resin and wax emulsion to be made rather than separate resin and wax emulsions. Further, in these embodiments, the combined emulsion allows for reduction in the amount of surfactant needed to prepare separate emulsions for incorporation into toner compositions. This is particularly helpful in instances where it would otherwise be difficult to incorporate the wax into the emulsion. However, in embodiments, the wax can also be separately emulsified, such as with a resin, and separately incorporated into final products.

In addition to the polymer binder resin, the toners of the present disclosure also contain a wax, either a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Suitable examples of waxes include waxes selected from natural vegetable waxes, natural animal waxes, mineral waxes, synthetic waxes and functionalized waxes. Examples of natural vegetable waxes include, for example, carnauba wax, candelilla wax, rice wax, sumacs wax, jojoba oil, Japan wax, and bayberry wax. Examples of natural animal waxes include, for example, beeswax, punic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

Examples of waxes of embodiments include polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight Mw of from about 500 to about 2,000, such as from about 1,000 to about 1,500, while the commercially available polypropylenes utilized have a molecular weight of about 1,000 to about 10,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., chlorinated polypropylenes and polyethylenes commercially available from Allied Chemical and Petrolite Corporation and Johnson Diversey, Inc. Many of the polyethylene and polypropylene compositions useful in embodiments are illustrated in British Pat. No. 1,442,835, the entire disclosure of which is incorporated herein by reference.

The toners may contain the wax in any amount of from, for example, about 1 to about 25 percent by weight of toner, such as from about 3 to about 15 percent by weight of the toner, on a dry basis; or from about 5 to about 20 percent by weight of the toner, such as from about 5 to about 11 percent weight of the toner.

Colorants

In embodiments, the toners may also contain at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. In embodiments, the colorant comprises a pigment, a dye, mixtures thereof, carbon black, magnetite, black, cyan, magenta, yellow, red, green, blue, brown, mixtures thereof, in an amount of about 0.1 percent to about 35 percent by weight based upon the total weight of the composition, such as from about 1 to about 25 percent by weight. It is to be understood that other useful colorants will become readily apparent based on the present disclosures.

In general, useful colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-1,1-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600× and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI-60710, CI Dispersed Red 15, diazo dye identified in the Color Index as CI-26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

The colorant, such as carbon black, cyan, magenta and/or yellow colorant, is incorporated in an amount sufficient to impart the desired color to the toner. In general, pigment or dye is employed in an amount ranging from about 1 to about 35 percent by weight of the toner particles on a solids basis, such as from about 5 to about 25 percent by weight or from about 5 to about 15 percent by weight. However, amounts outside these ranges can also be used, in embodiments.

Coagulants

The emulsion aggregation process for making toners of the present disclosure also contains at least a coagulant, such as a monovalent metal coagulant, a divalent metal coagulant, a polyion coagulant, or the like. A variety of coagulants are known in the art, as described above. As used herein, "polyion coagulant" refers to a coagulant that is a salt or oxide, such as a metal salt or metal oxide, formed from a metal species having a valence of at least 2 to about 11, such as from about 3 to about 7 or from about 4 to about 6. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds in embodiments have from about 2 to about 11, aluminum ions present in the compound.

Such coagulants can be incorporated into the toner particles prior to particle aggregation. As such, the coagulant can be present in the toner particles, exclusive of external additives and on a dry weight basis, in amounts of from 0 to about 5 percent by weight of the toner particles, such as from about greater than 0 to about 3 percent by weight of the toner particles.

Ion Solutions

In embodiments, salts, bases, buffers, and combinations of salts, bases, and buffers may be used to freeze the size of the aggregates.

Suitable salts or bases utilized to increase the pH and hence ionize the aggregate particles thereby providing stability and preventing the aggregates from growing in size include, but are not limited to, metallic salts of aliphatic acids or aromatic acids and bases, such as sodium hydroxide, ammonium hydroxide, sodium tetraborate, cesium hydroxide, potassium acetate, zinc acetate, sodium dihydrogen phosphate, disodium hydrogen phosphate, potassium formate, potassium hydroxide, sodium oxalate, sodium phthalate, potassium salicylate, combinations thereof, and the like.

Suitable buffers may also be used. In embodiments, a buffer system may include at least two of acids, salts, bases, organic compounds, and combinations thereof in a solution with deionized water as the solvent. The bases may be selected from those listed above. Suitable acids that can be utilized include, but are not limited to, organic and/or inorganic nitric acids such as sulfuric acid, hydrochloric acid, acetic acid, citric acid, trifluoro acetic acid, succinic acid, salicylic acid, combinations thereof, and the like. Suitable organic compounds include, but are not limited to, tris(hydroxymethyl)aminomethane ("TRIS"), Tricine, Bicine, Glycine, sodium acetate, HEPES, Trietholamine hydrochloride, MOPS, combinations thereof, and the like.

In embodiments, salts, bases, acids, buffers, and combinations of salts, bases, acids, and buffers may be used to coalesce the particles. Examples of such salts, bases, acids, buffers, and combinations thereof may be found in U.S. patent application Ser. No. 12/056,337, the entire disclosure of which is incorporated herein by reference.

Emulsion Aggregation Procedures

Any suitable emulsion aggregation procedure may be modified according to the present disclosure and used in forming the emulsion aggregation toner particles without restriction. These procedures typically include the basic process steps of at least aggregating an emulsion containing polymer binder and one or more optional waxes, one or more colorants, one or more surfactants, a coagulant, and one or more additional optional additives to form aggregates, subsequently coalescing or fusing the aggregates, and then recovering, optionally washing, and optionally drying the obtained emulsion aggregation toner particles.

According to this disclosure, typical emulsion aggregation toner processes can be modified to include cold addition and to eliminate a homogenization step. Cold addition, prior to aggregation and coalescence, provides for an emulsion aggregation process where homogenization is unnecessary. Cold addition allows for a better distribution of the coagulant because at cold temperatures, the coagulant is inactivated. This, in turn eliminates the need for homogenization, enables better control of particle size, better control of GSD, and decreases particle coarseness. Thus, in embodiments, the temperature may be adjusted so that the coagulant is completely inactivated. "Completely inactivated" coagulants include coagulants that perform no measurable level of coagulation activity. In embodiments, slurries containing inactivated coagulants do not require homogenization to result in acceptable toner particle parameters.

In embodiments, "cold" includes any temperature at which the coagulant is inactivated. Cold temperatures include temperatures below room temperature, such as less than about 17° C., less than about 15° C., less than about 10° C., less than about 9° C., less than about 5° C., or less than about 4° C. In embodiments, cold homogenization may be carried out at about 0.5 to about 17° C., about 0.5 to about 15° C., about 0.5 to about 9° C., or about 0.1 to about 5° C.

By introducing a cold addition method into the emulsion aggregation process, the pre-aggregated particle size can be reduced by a factor of about 10 or more. For example, the particle size can be reduced in the lab from about 1.7 μm to about 170 nm. In the plant, the particle size can be reduced by a factor greater than 10, for example from about 3.3 μm to about 209 nm.

In embodiments, the pre-aggregated particles resulting from the process are from about 2.8 μm (2800 nm) to about 100 nm, such as about 200 nm, about 300 nm, or about 400 nm. Thus the particles may be about 2.8 μm or less, such as 2 μm or less, about 1 μm or less, about 400 nm or less, about 300 nm or less, about 200 nm or less, or about 100 nm or less.

In embodiments, the amount of air ingestion due to homogenization is decreased because homogenization is eliminated. Thus, the pre-aggregated particles may have an initial slurry density of greater than about 0.7 g/cc or about 0.8 g/cc, such as from about 0.7 g/cc to about 1 glee or from about 0.8 g/cc to about 0.9 g/cc.

In embodiments, the finished toner particles resulting from the above pre-aggregated particles may be as large as about 20 μm or larger. The finished toner particles may also be smaller, such as from about 19 μm to about 2.5 μm, or from about 4.5 μm to about 3 μm. Thus the particles may be about 19 μm or less, such as about 4.9 μm or less, about 4 μm or less, or about 3 μm or less.

It is also desirable to control the toner particle size and limit the amount of both fine and coarse toner particles in the toner. In an embodiment, the toner particles have a very narrow particle size distribution with a lower number GSD of about 1.15 to about 1.30, or about less than 1.25. The toner particles of the present disclosure also can have a size such that the upper GSD by volume is in the range of from about 1.15 to about 1.30, such as from about 1.18 to about 1.22, or less than about 1.25. These GSD values for the toner particles of the present disclosure indicate that the toner particles are made to have a very narrow particle size distribution.

In embodiments, average particle coarse % is also reduced when compared with particles produced by conventional emulsion aggregation methods. For example, in typical methods, coarse % of working particles may be from about 5 to about 1.1. However, in embodiments employing the above process, coarse % can be from about 1.5 to about zero.

Suitable emulsion aggregation/coalescing processes for the preparation of toners, and which can be modified to include cold mixing as described herein, are illustrated in a number of Xerox patents, the disclosures of each of which are totally incorporated herein by reference, such as U.S. Pat. Nos. 5,290,654; 5,278,020; 5,308,734; 5,370,963; 5,344,738; 5,403,693; 5,418,108; 5,364,729; 5,346,797; 6,627,373; 6,656,657; 6,617,092; 6,638,677; 6,576,389; 6,664,017; 6,656,658; and 6,673,505. Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby totally incorporated herein by reference. The appropriate components and process aspects of each of the foregoing U.S. Patents may be selected for the present composition and process in embodiments thereof.

EXAMPLES

Example 1 and Comparative Example 1 demonstrate the benefits of cold addition as opposed to room temperature addition.

Example 1

A cyan polyester toner was prepared at the 2 L Bench scale (200 g dry theoretical toner). Two amorphous emulsions comprising terpoly-(propoxylated bisphenol A-fumarate)-terpoly (propoxylated bisphenol A-terephthalate)-terpoly-(propoxylated bisphenol A-2-dodecylsuccinate) as a resin and Dowfax as a surfactant, a crystalline emulsion comprising poly (nonane-dodecanoiate) as a resin and Dowfax as a surfactant, additional surfactant (Dowfax), a wax (IGI wax, available as "D1509" from The International Group, Inc.), and a pigment (Cyan 15:3 Dispersion) were mixed and cooled in an ice bath to 3-4° C. After which, the pH was adjusted to 4.2 using 0.3 M nitric acid. The cold slurry was then transferred to a cold (jacket temperature at 5° C.) 2 L Buchi and mixed at 430 rpm. Over the course of 5 minutes, a coagulant, aluminum sulphate, was added to the Buchi. Once completed, a sample quenched in 4% NaOH and DIW (at room temperature) was taken for particle size measurement on the Nanotrac. Initial particle size (D50) was recorded at 207.4 nm with a standard deviation of 0.2502.

The slurry was then aggregated at a batch temperature of 40° C., then raised to 44° C. During aggregation, a shell comprising the same amorphous emulsion in the core was added to achieve the targeted particle size. The aggregation step was frozen with pH adjustment using pH 9 TRIS-HCl buffer, Sodium Hydroxide (NaOH), and EDTA. The process proceeded with the reactor temperature (Tr) being increased to achieve 85° C. At 80° C., the pH was adjusted to 7 using pH 5.7 buffer where the particles began to coalesce. After about 30 minutes, the particles achieved >0.965 cicularity and were cooled. Final toner particle size, GSDv, and GSDn were respectively 5.60 μm, 1.21, and 1.24. The fine % (1-4 μm), coarse % (>16 μm), and circularity were respectively 16.56%, 0.3% and 0.976. See Table 1 below.

Comparative Example 1

A cyan polyester toner was prepared at the 2 L Bench scale (200 g dry theoretical toner) using the materials of Example 1 at room temperature. The amorphous emulsions, crystalline emulsion, surfactant, wax, and pigment were mixed at room temperature (22-25° C.) and then pH adjusted to 4.2 using 0.3 M nitric acid. The room temperature slurry was then transferred to the 2 L Buchi and mixed at 430 rpm. Over the course of 5 minutes, the coagulant, aluminum sulphate, was added to the Buchi. Once completed, a sample quenched in 4% NaOH and DIW (at room temperature) was taken for particle size measurement on the Coulter Counter. Initial particle size (D50) was recorded at 4.05 μm with 2.53% coarse (>16 μm). The slurry was then aggregated at a batch temperature of 40° C. Particle size, GSDv, GSDn, and coarse % (>16 μm) were respectively 5.31 μm, 1.4461, 1.3768, and 7.35%. See Table 1 below. Because of the unacceptable GSDv, GSDn, and coarseness measurements (coarse content), the aggregated particles were not continued on to coalescence.

TABLE 1

| | Example 1 | Comparative Example 1 |
|---|---|---|
| Coagulant addition temperature | Cold (5° C.) | Room temperature |
| Final Particle Size (D50) | 5.60 μm | 5.31 μm |
| GSDv | 1.21 | 1.4461 |
| GSDn | 1.24 | 1.3768 |
| Coarse % (>16 pm) | 0.3% | 7.35% |
| Circularity | 0.976 | N/A |

Example 2 and Comparative Examples 2 and 3 demonstrate how the above described process can accommodate increased surfactant loads.

Example 2

A cyan polyester toner was prepared at the 2 L Bench scale (190 g dry theoretical toner) with the materials of Example 1, except that the mixture contained 5.1 pph of surfactant based on thy toner. The amorphous emulsions, crystalline emulsion, surfactant, and pigment were mixed and cooled in an ice bath to 3-4° C. After which, the pH was adjusted to 4.2 using 0.3 M nitric acid. The cold slurry was then transferred to a cold (jacket temperature at 5° C.) 2 L Buchi and mixed at 300 rpm. Over the course of 10 minutes, a coagulant, aluminum sulphate, was added to the Buchi. Once completed, a sample quenched in Isoton solution (at room temperature) was taken for particle size measurement on the Nanotrac. Initial particle size (D50) was recorded at 170 nm with a standard deviation of 0.072.

The slurry was then aggregated at a batch temperature of 45° C. During aggregation, a shell comprised of the same amorphous emulsion in the core was added and then heated to achieve the targeted particle size. The aggregation step was frozen with a pH adjustment using ph 9 TRIS-HCl buffer, Sodium Hydroxide (NaOH) and EDTA. The process proceeded with the reactor temperature (Tr) being increased to achieve 85° C. At 84° C., the pH was adjusted to 6.4 using pH 5.7 buffer where the particles began to coalesce. After about 40 minutes, the particles achieved >0.965 circularity and were cooled. Final particle size (D50), GSDv, GSDn, coarse % (>16 μm), and circularity were respectively 7.11 μM, 1.2253, 1.2609, 0.37%, and 0.981. See Table 2 below.

Comparative Example 2

A cyan polyester toner was prepared at the 2 L Bench scale (300 g dry theoretical toner) with the emulsions and pigment of Example 1. In this example, the mixture contained 4.5 pph of surfactant based on dry toner. The amorphous emulsions, crystalline emulsion, and pigment were mixed and then pH adjusted to 4.2 using 0.3 M nitric acid at room temperature. The slurry was then homogenized for a total of 10 minutes at 3000-6000 rpm while adding in a coagulant, aluminum sulphate. The toner slurry was then transferred to the 2 L Buchi and heated to begin aggregation.

Typically, the aggregation temperature is <50° C. for a basic toner; however, this toner did not form proper aggregates even at 56° C. The toner was too stable and did not incorporate all the raw materials, resulting in a toner that was too small with an unacceptable GSD. At 56° C., particle size (D50), GSDv, GSDn, and coarse % (>16 μm) were respectively 3.35 μm, 1.4970, 1.4125, and 11.15%. See Table 2 below. Because the toner would not aggregate, the batch was stopped.

Comparative Example 3

A cyan polyester toner was prepared at the 2 L Bench scale (150 g dry theoretical toner) with one amorphous emulsion comprising terpoly-(propoxylated bisphenol A-fumarate)-terpoly(propoxylated bisphenol A-terephthalate)-terpoly-(propoxylated bisphenol A-2-dodecylsuccinate) as a resin and Dowfax as a surfactant, a crystalline emulsion comprising poly(nonane-dodecanoiate) as a resin and Dowfax as a surfactant, and a pigment (Cyan 15:3 Dispersion). In this example, the mixture contained 5.0 pph of surfactant based on the dry toner. The components were mixed and then pH adjusted to 4.2 using 0.3 M nitric acid at room temperature. The slurry was then homogenized for a total of 10 minutes at 3000-6000 rpm while adding in a coagulant, aluminum sulphate. Once completed, the slurry was heated to aggregate the toner particles to the desired particle size. Once at the targeted particle size, a shell comprising the same amorphous emulsion in the core was added to achieve a 5 μm particle. The aggregation step was then frozen with a pH adjustment using ph 9 TRIS-HCl buffer, Sodium Hydroxide (NaOH), and EDTA. The process proceeded with the reactor temperature (Tr) being increased to achieve 85° C. At 84° C., the pH was adjusted to 7.6 using pH 5.7 buffer where the particles began to coalesce. After about 1 hour, the particles achieved >0.965 circularity and were cooled. Final particle size (D50), GSDv, GSDn, coarse % (<16 μm to 10 μm), coarse % (>16 μm), and circularity were respectively 5.42 μm, 1.2591, 1.2392, 4.56%, 1.32%, and 0.971.

This toner failed both GSDv and coarse specs because the toner slurry viscosity during the homogenization step was too thin. The higher surfactant levels in the toner formulation prevented the homogenizer from effectively grinding/homogenizing the coarse particles that were generated while the coagulant was being added.

TABLE 2

| | Example 2 | Comparative Example 2 | Comparative Example 3 |
|---|---|---|---|
| Coagulant addition temperature | Cold (5° C.) | Room temperature | Room Temperature |
| Surfactant Load | 5.1 pph | 4.5 pph | 5.0 pph |
| Final Particle Size (D50) | 7.11 μm | 3.35 μm | 5.42 μm |
| GSDv | 1.2253 | 1.4970 | 1.2591 |
| GSDn | 1.2609 | 1.4125 | 1.2392 |
| Coarse % (>16 um) | 0.37% | 11.5% | 1.32% |
| Circularity | 0.981 | N/A | 0.971 |

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of making toner particles, comprising:

mixing, at a temperature of less than about 15° C. and without homogenizing, a resin emulsion with a coagulant, a colorant, an optional wax, and optional additives, to form pre-aggregated particles in a slurry;

heating the slurry to form aggregated toner particles;

freezing aggregation of the particles in the slurry once at a desired aggregated particle size; and further heating the aggregated particles in the slurry to coalesce the aggregated particles into toner particles.

2. The method of claim 1, wherein the mixing is carried out at a temperature of less than about 9° C.

3. The method of claim 1, wherein the coagulant comprises a coagulant selected from the group consisting of a monovalent metal coagulant, a divalent metal coagulant, and a polyion coagulant.

4. The method of claim 1, wherein the coagulant is aluminum sulphate.

5. The method of claim 1, wherein a surfactant is present in the toner slurry in an amount of from about 0.01 to about 15 pph.

6. The method of claim 1, wherein the resin emulsion was made by a solvent-free resin emulsification.

7. The method of claim 1, wherein the method is carried out in one reactor.

8. The method of claim 1, wherein the method is carried out as a continuous process.

9. The method of claim 1, wherein the final toner particle size is about 2.5 to about 10 μm.

10. The method of claim 1, wherein the GSD by number of the final toner particles is less than or equal to about 1.30.

11. The method of claim 1, wherein coarse content of the toner particles is less than 1%.

12. The method of claim 1, wherein the pre-aggregated particles have an initial average particle size of less than about 2.8 μm.

13. The method of claim 1, wherein the pre-aggregated particles have an initial slurry density of greater than about 0.8 g/cc.

14. A method of making toner particles, comprising:

mixing, without homogenizing, a resin emulsion with a coagulant, a colorant, an optional wax, and optional additives, to form pre-aggregated particles in a slurry, wherein the mixing is carried out at a temperature of less than about 17° C. that completely inactivates the coagulant;

heating the slurry to form aggregated toner particles;

freezing aggregation of the particles in the slurry once at a desired aggregated particle size; and further heating the aggregated particles in the slurry to coalesce the aggregated particles into toner particles.

15. The method of claim 14, wherein the mixing is carried out at a temperature of less than about 9° C.

16. The method of claim 14, wherein the coagulant comprises a coagulant selected from the group consisting of a monovalent metal coagulant, a divalent metal coagulant, and a polyion coagulant.

17. The method of claim 14, wherein the coagulant is aluminum sulphate.

18. The method of claim 14, wherein a surfactant is present in the toner slurry in an amount of from about 0.01 to about 15 pph.

19. A method of making toner particles, comprising:

mixing, at a temperature of less than about 17° C. and without homogenizing, a resin emulsion with a coagulant, a colorant, an optional wax, and an optional additive, to form pre-aggregated particles in a slurry, wherein the resin emulsion comprises a UV curable resin and the optional additive comprises a photoinitiator;

heating the slurry to form aggregated toner particles;

freezing aggregation of the particles in the slurry once at a desired aggregated particle size; and further heating the aggregated particles in the slurry to coalesce the aggregated particles into toner particles.

* * * * *